US009289672B2

(12) United States Patent
Francis

(10) Patent No.: US 9,289,672 B2
(45) Date of Patent: Mar. 22, 2016

(54) SAFE LIFT GUIDE

(71) Applicant: Kenroy Anthony Francis, Fort Lauderdale, FL (US)

(72) Inventor: Kenroy Anthony Francis, Fort Lauderdale, FL (US)

( * ) Notice: Subject to any disclaimer, the term of this patent is extended or adjusted under 35 U.S.C. 154(b) by 0 days.

(21) Appl. No.: 14/289,758

(22) Filed: May 29, 2014

(65) Prior Publication Data

US 2015/0343296 A1 Dec. 3, 2015

(51) Int. Cl.

| | |
|---|---|
| ***A63B 21/00*** | (2006.01) |
| ***A63B 71/00*** | (2006.01) |
| ***A63B 21/072*** | (2006.01) |

(52) U.S. Cl.

CPC ..... *A63B 71/0036* (2013.01); *A63B 21/072* (2013.01)

(58) Field of Classification Search

CPC ..... A63B 21/00
USPC ..... 482/104, 106, 94
See application file for complete search history.

(56) References Cited

U.S. PATENT DOCUMENTS 6,149,556 A * 11/2000 Jordan ..... 482/104
6,939,274 B2 * 9/2005 Emick ..... 482/104

* cited by examiner

*Primary Examiner* — Jerome W Donnelly
(74) *Attorney, Agent, or Firm* — USAPatents.com; Divya Khullar, Esq.

(57) ABSTRACT

In accordance with one embodiment, a dumbbell attachment is provided. The primary object of the present invention is to provide an apparatus to aid athletes who train with weights, specifically dumbbells. The present invention will receive and support a dumbbell safely and comfortably.

10 Claims, 6 Drawing Sheets

SAFE LIFT GUIDE

BACKGROUND OF THE INVENTION

1. Field of the Invention

Embodiments of the present invention generally relate to dumbbell attachment, and more particularly to provide dumbbell attachment adaptable for bench and walls.

2. Description of the Related Art

The present invention relates to weightlifting exercise equipment for use in connection with supporting dumbbells used in Weight training associated with physical fitness. Further, it is an adjustable dumbbell support assembly for conveniently and safely adjusting dumbbell supports to desired positions for use in exercising with dumbbells. More particularly, the Weight bench with dumbbell supports provides utility in connection with supporting both dumbbell and barbell style weights. Many individuals who train and exercise with weights prefer to use dumbbell style free weights because of the variety of unrestricted positioning during exercise permitting the use of free weights.

Dumbbells enable the utmost freedom of positioning, in that, when gripped by one hand, they can be moved in virtually any position attainable by the body of the user. Such freedom of movement provides the utmost capability for variety in exercises and enables users to precisely target and work desired muscle areas. The use of dumbbells are limited by the requirement that the user must start with the dumbbells either resting on the floor or on a dumbbell support device of the type generally known which do not provide a variety of resting positions. Depending on what exercise a user is performing, the size of the user, and the amount of weight he or she is using—the desired start and finish positions for the dumbbells could vary.

Typically, there is no desirable starting position in either situation, the dumbbell users have to forego certain exercises, use less weight than is desirable, perform less repetitions, or subject themselves to danger when working out. Lastly, modification of the support columns is not required, but rather is mounted upon the horizontally-disposed cross bar of the barbell.

SUMMARY

In accordance with one embodiment, a dumbbell attachment is provided. The primary object of the present invention is to provide an apparatus to aid athletes who train with weights, specifically dumbbells. The present invention will receive and support a dumbbell safely and comfortably.

It is another object of the invention to provide such an apparatus which can be inserted onto a column of an exercise weight bench. In accordance with one embodiment, a dumbbell attachment for use with a barbell exercise weight bench having a pair of vertical tubular members. The dumbbell attachment having a hollow tubular cover configured to slide onto the tubular members allowing adjustable height dumbbell attachment.

The dumbbell attachment may further have a first set of one or more holes in the hollow tubular cover on the first side. A second set of one or more holes in the hollow tubular cover on the second side. The first and the second set of one or more holes forming a matching set across the opposite sides or diametrical opposite edges of the tubular cover, each matching set of holes at the same level. A rack assembly configured for supporting dumbbell, the rack assembly having a connector member. The two body members for supporting a dumbbell are attached to the connector member. The body members being spaced sufficiently far apart from each other to permit the insertion of a hand therebetween to allow for a person to manipulate the dumbbell.

In accordance with an embodiment the rack assembly for supporting dumbbell for the right hand. The right hand rack assembly wherein the connector member coplanar to the hollow tubular cover and the connector member is protruding left of the hollow tubular cover. The hollow tubular cover and the connector member forming a right angle with the hollow tubular cover.

The dumbbell attachment wherein the connector member may include a sleeve enabling the connector member with an adjustable length leftwards. Furthermore, the rack assembly for supporting dumbbell may be a left hand rack assembly. The left hand rack assembly configured for supporting dumbbells for the left hand. In the left hand rack assembly a connector member is coplanar to the hollow tubular cover such that the connector member protrudes right of the hollow tubular cover forming a right angle with the hollow tubular cover.

Each of the body members is a distinct shape of a harvesting sickle as viewed from one side. In one embodiment, the handle having an adjustable length. The handle of the harvesting sickle is a distal end of the body member which attaches to the connector member. The dumbbell attachment may include means for adjusting securely the hollow tubular cover at various heights of the vertical tubular member. The hollow tubular cover and the connector member being coplanar, forming a two dimensional planes with the body member at a right angle with the connector member.

In accordance with another embodiment, a dumbbell attachment forming a fixture to a wall or door or panel is provided. The dumbbell attachment may include a backing member having a means to attach to the wall or door or panel. In addition, the dumbbell attachment may include a hollow tubular cover connected to the backing member. Moreover, the dumbbell attachment may also include a tubular members configured to slide into the hollow tubular cover enabling an adjustable height dumbbell attachment. The dumbbell attachment forming a fixture has a rack assembly configured for supporting dumbbell.

The preceding description of the preferred embodiment of the invention has been presented for the purpose of illustration and description. It is not intended to be exhaustive or to limit the invention to the precise form disclosed. Many modifications and variations are possible in light of the above teaching. It is intended that the scope of the invention be limited not by this detailed description, but rather to the claims appended hereto.

BRIEF DESCRIPTION OF THE DRAWINGS

The drawings, in which like numerals represent similar parts, illustrate generally, by way of example, but not by way of limitation, various embodiments discussed in the present document.

DETAILED DESCRIPTION

Figure 1:
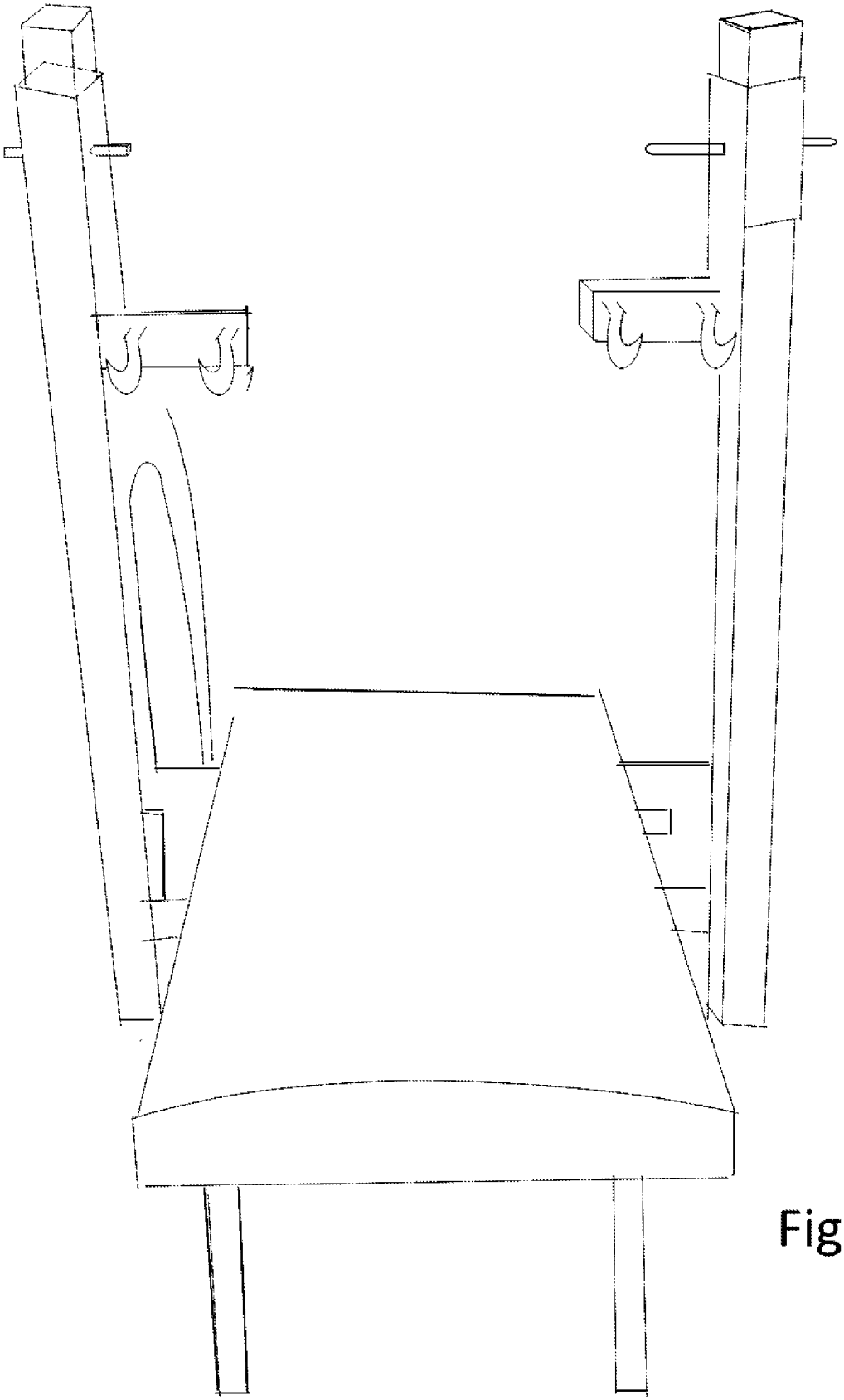
FIG. 1 illustrates the dumbbell attachment inserted onto a column of an exercise weight bench in accordance with an embodiment.

The foregoing summary, as well as the following detailed description of certain embodiments of the subject matter set forth herein, will be better understood when read in conjunction with the appended drawings. As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or one or more elements having a particular property may include additional such elements not having that property.

To the extent that the term "includes" is used in either the detailed description or the claims, such term is intended to be inclusive in a manner similar to the term "comprising" as "comprising" is interpreted when employed as a transitional word in a claim. Furthermore, the term "or" as used in either the detailed description or the claims is intended to mean an inclusive "or" rather than an exclusive "or." That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B.

In the following detailed description, reference is made to the accompanying drawings which form a part hereof, and in which are shown by way of illustration specific embodiments in which the subject matter disclosed herein may be practiced. These embodiments, which are also referred to herein as "examples," are described in sufficient detail to enable those skilled in the art to practice the subject matter disclosed herein. It is to be understood that the embodiments may be combined or that other embodiments may be utilized, and that structural, logical, and electrical variations may be made without departing from the scope of the subject matter disclosed herein. The following detailed description is, therefore, not to be taken in a limiting sense, and the scope of the subject matter disclosed herein is defined by the appended claims and their equivalents. In the description that follows, like numerals or reference designators will be used to refer to like parts or elements throughout. In this document, the terms "a" or "an" are used, as is common in patent documents, to include one or more than one. In this document, the term "or" is used to refer to a nonexclusive or, unless otherwise indicated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

The Dumbbell attachment for is an aid to athletes training with weights and specifically dumbbells. Used for its intended purpose when the single vertical support is inserted onto an exercise weight bench column, the present invention successfully receives and supports a dumbbell. The distinct sickle shaped rack assembly with the opening for the hand to pass through reveals this invention to be simple in design as well as functionalistic.

The primary object of the present invention is to provide an apparatus to aid athletes who train with weights, specifically dumbbells. The present invention will receive and support a dumbbell safely and comfortably. It is another object of the invention to provide such an apparatus which can be inserted onto a column of an exercise weight bench. In accordance with one embodiment, a dumbbell attachment for use with a barbell exercise weight bench having a pair of vertical tubular members. The dumbbell attachment having a hollow tubular cover configured to slide onto the tubular members allowing adjustable height dumbbell attachment.

Figure 2:
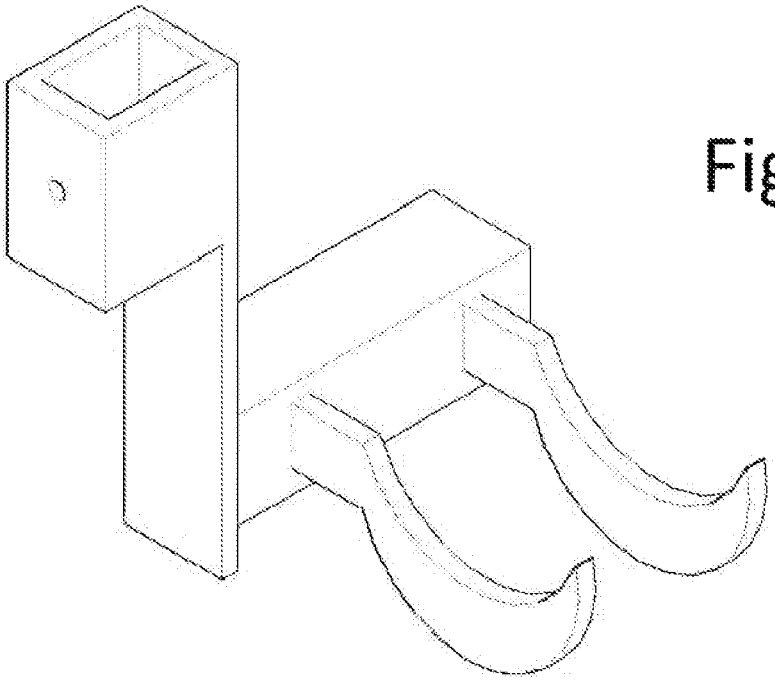
FIG. 2 illustrates a perspective view of a single dumbbell attachment in accordance with an embodiment.
Figure 3:
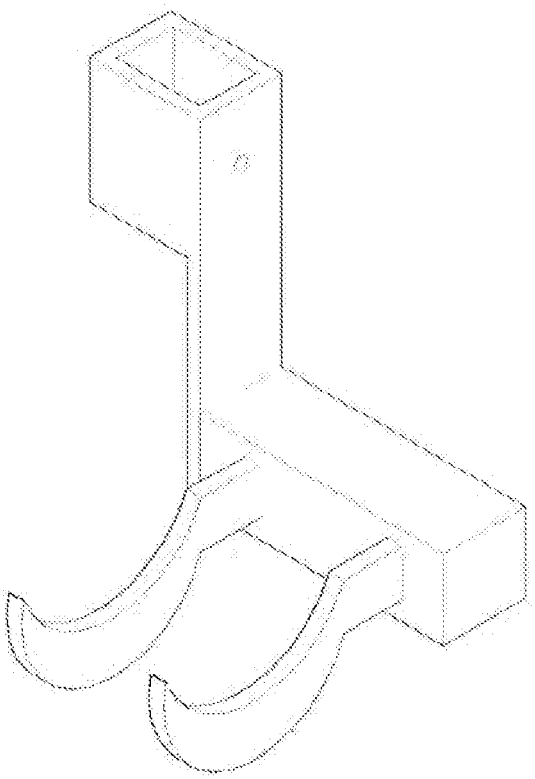
FIG. 3 illustrates a perspective view of an alternate embodiment of a dumbbell attachment in accordance with an embodiment.
Figure 4:
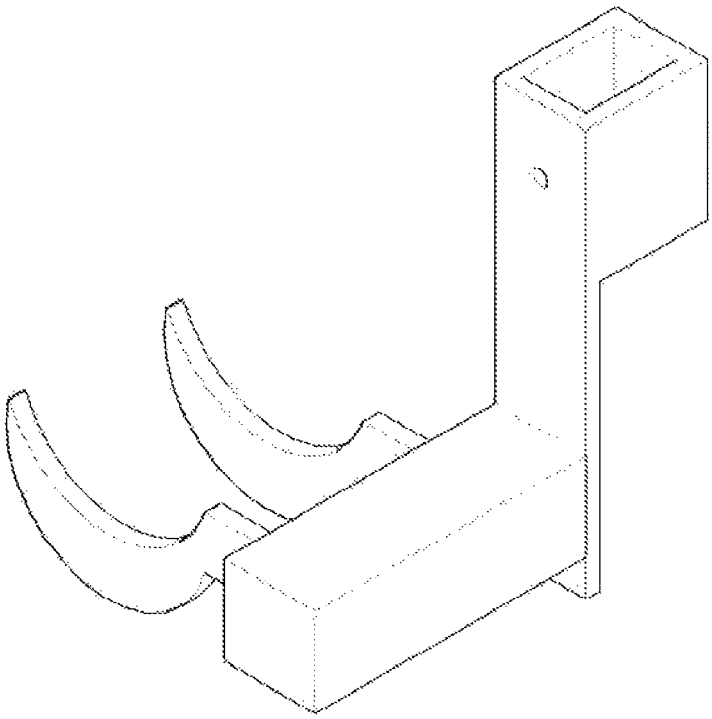
FIG. 4 illustrates another perspective view of an embodiment of a dumbbell attachment in accordance with an embodiment.

FIG. 1 illustrates a perspective view of a single dumbbell attachment in accordance with an embodiment. FIG. 2 illustrates a perspective view of an alternate embodiment of a dumbbell attachment in accordance with an embodiment. FIG. 3 illustrates a perspective view of an alternate embodiment of a dumbbell attachment in accordance with an embodiment. FIG. 4 illustrates another perspective view of an embodiment of a dumbbell attachment in accordance with an embodiment. The dumbbell attachment may further have a first set of one or more holes in the hollow tubular cover on the first side. A second set of one or more holes in the hollow tubular cover on the second side. The first and the second set of one or more holes forming a matching set across the opposite sides or diametrical opposite edges of the tubular cover, each matching set of holes at the same level. A rack assembly configured for supporting dumbbell, the rack assembly having a connector member. The two body members for supporting a dumbbell are attached to the connector member. The body members being spaced sufficiently far apart from each other to permit the insertion of a hand therebetween to allow for a person to manipulate the dumbbell.

In accordance with an embodiment the rack assembly for supporting dumbbell for the right hand. The right hand rack assembly wherein the connector member coplanar to the hollow tubular cover and the connector member is protruding left of the hollow tubular cover. The hollow tubular cover and the connector member forming a right angle with the hollow tubular cover.

The dumbbell attachment wherein the connector member may include a sleeve enabling the connector member with an adjustable length leftwards. Furthermore, the rack assembly for supporting dumbbell may be a left hand rack assembly. The left hand rack assembly configured for supporting dumbbells for the left hand. In the left hand rack assembly a connector member is coplanar to the hollow tubular cover such that the connector member protrudes right of the hollow tubular cover forming a right angle with the hollow tubular cover.

Figure 5:
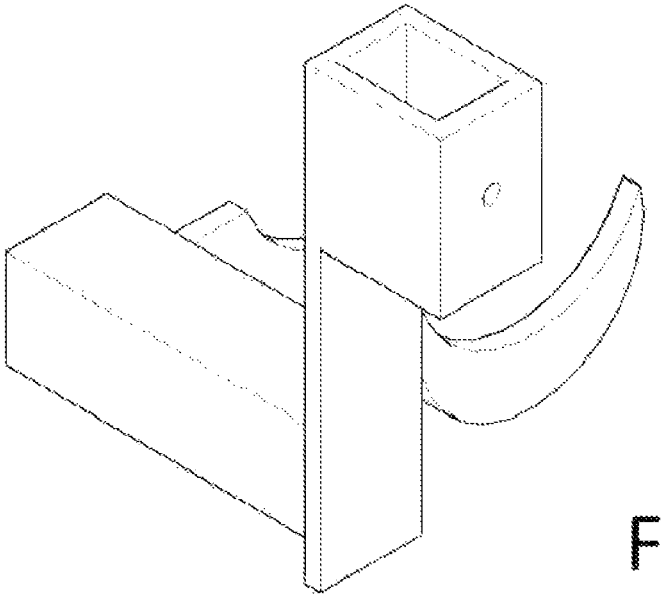
FIG. 5 illustrates another perspective view of an embodiment of a dumbbell attachment in accordance with an embodiment.
Figure 6:
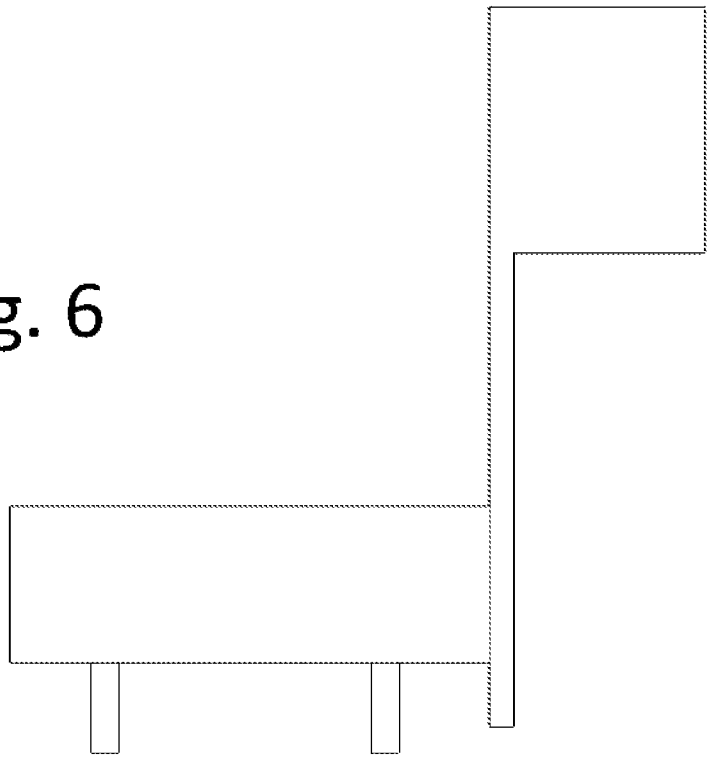
FIG. 6 illustrates a back view of an embodiment of a dumbbell attachment in accordance with an embodiment.
Figure 7:
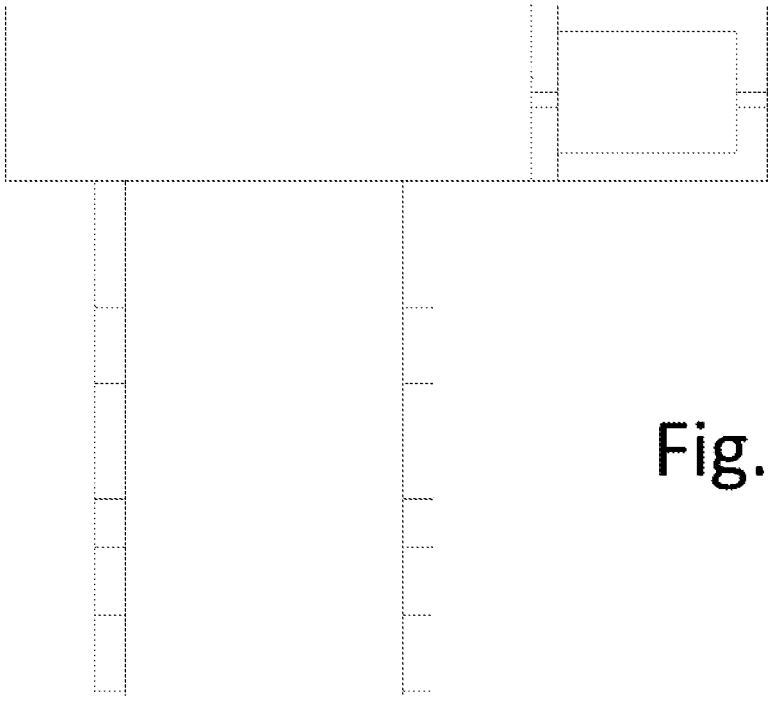
FIG. 7 illustrates a bottom view of an embodiment of a dumbbell attachment in accordance with an embodiment.
Figure 8:
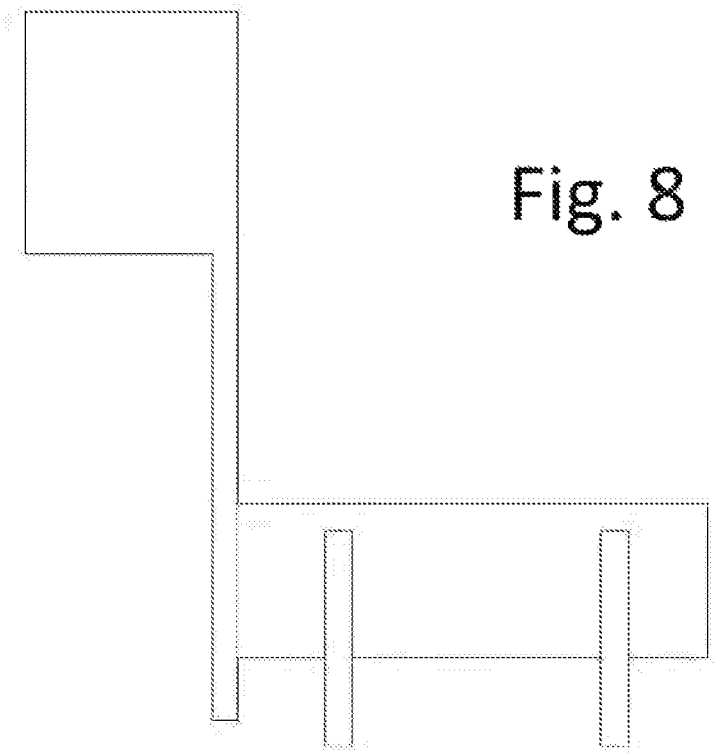
FIG. 8 illustrates a front view of an embodiment of a dumbbell attachment in accordance with an embodiment.
Figure 9:
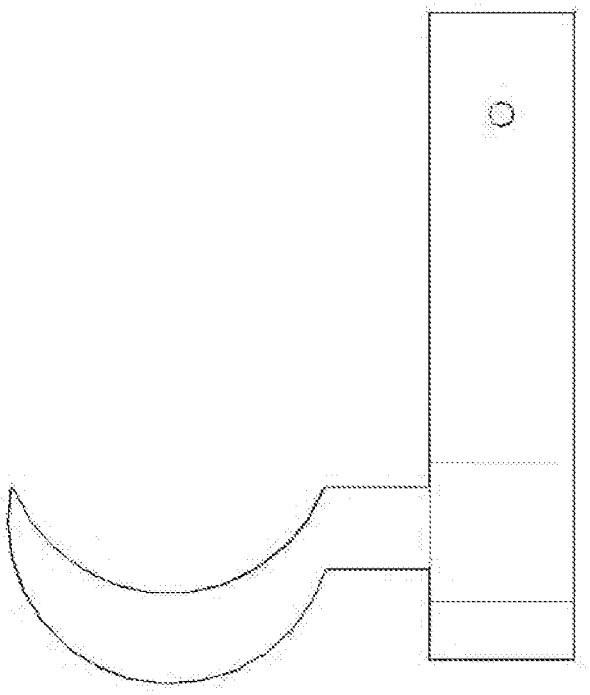
FIG. 9 illustrates a left profile view of an embodiment of a dumbbell attachment in accordance with an embodiment.

FIG. 5 illustrates another perspective view of an embodiment of a dumbbell attachment in accordance with an embodiment. FIG. 6 illustrates a back view of an embodiment of a dumbbell attachment in accordance with an embodiment. FIG. 7 illustrates a bottom view of an embodiment of a dumbbell attachment in accordance with an embodiment. FIG. 8 illustrates a front view of an embodiment of a dumbbell attachment in accordance with an embodiment. FIG. 9 illustrates a left profile view of an embodiment of a dumbbell attachment in accordance with an embodiment. Each of the body members is a distinct shape of a harvesting sickle as viewed from one side. In one embodiment, the handle having an adjustable length. The handle of the harvesting sickle is a distal end of the body member which attaches to the connector member. The dumbbell attachment may include means for adjusting securely the hollow tubular cover at various heights of the vertical tubular member. The hollow tubular cover and the connector member being coplanar, forming a two dimensional planes with the body member at a right angle with the connector member.

Figure 10:
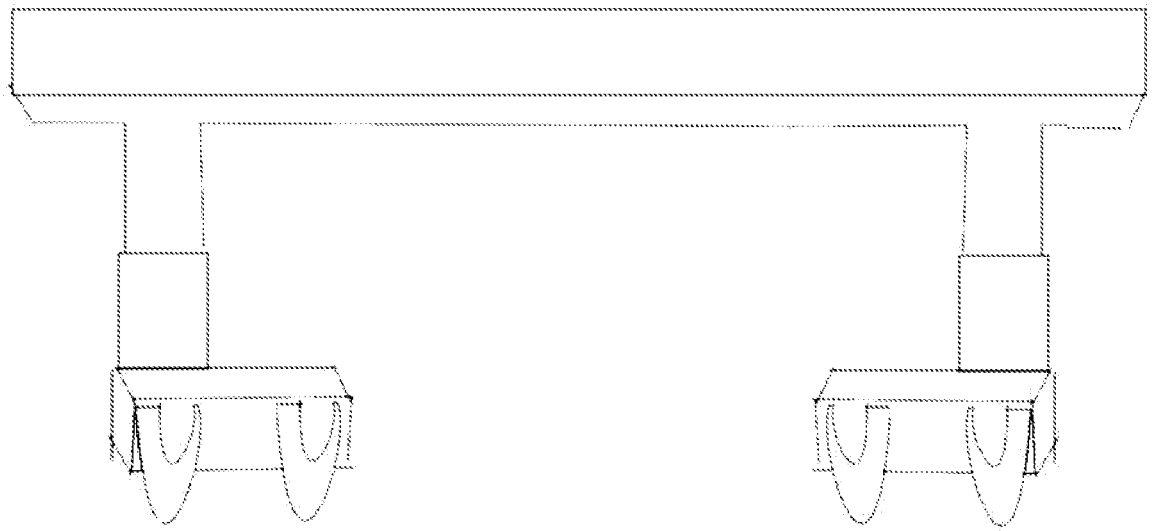
FIG. 10 illustrates a dumbbell attachment forming a fixture to a wall or door or panel in accordance with an embodiment.

FIG. 10 illustrates a dumbbell attachment forming a fixture to a wall or door or panel in accordance with an embodiment. In accordance with another embodiment, a dumbbell attachment forming a fixture to a wall or door or panel is provided. The dumbbell attachment may include a backing member having a means to attach to the wall or door or panel. In addition, the dumbbell attachment may include a hollow tubular cover connected to the backing member. Moreover, the dumbbell attachment may also include a tubular members configured to slide into the hollow tubular cover enabling an adjustable height dumbbell attachment. The dumbbell attachment forming a fixture has a rack assembly configured for supporting dumbbell. The rack assembly having a connector member; and two body members for supporting a dumbbell, two body members attached to the connector member, the body members being spaced sufficiently far apart from each other to permit the insertion of a hand therebetween to allow for a person to manipulate the dumbbell.

The dumbbell attachment for wherein the rack assembly for supporting dumbbell is a right hand rack assembly configured for supporting dumbbells for the right hand. The connector member coplanar to the tubular member, the connector member protruding left of the tubular member forming a right angle with the tubular member. The dumbbell attachment wherein the connector member is configured to be an adjustable length leftwards.

The dumbbell attachment wherein the rack assembly for supporting dumbbell is a left hand rack assembly configured for supporting dumbbells for the left hand. a connector member coplanar to the tubular members, the connector member protruding right of the tubular members forming a right angle with the tubular members.

The dumbbell attachment wherein the connector member having an adjustable length rightwards. The dumbbell attachment wherein each of the body members having distinct harvesting sickle shape as viewed from one side. The dumbbell attachment wherein the handle of the harvesting sickle forming the distal end of the body member attached to the connector member.

The dumbbell attachment wherein the handle having an adjustable length. The dumbbell attachment further may include means for adjusting securely the hollow tubular cover at various heights of the vertical tubular member. The dumbbell attachment wherein the hollow tubular cover and the connector member being coplanar, forming a two dimensional planes with the body member at a right angle with the connector member.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions, types of materials and coatings described herein are intended to define the parameters of the invention, they are by no means limiting and are exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

This written description uses examples to disclose the various embodiments of the invention, including the best mode, and also to enable any person skilled in the art to practice the various embodiments of the invention, including making and using any devices or systems and performing any incorporated methods. The patentable scope of the various embodiments of the invention is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal languages of the claims.

What is claimed is:

1. A dumbbell attachment forming a fixture to a wall or door or panel, the dumbbell attachment comprising:

a backing member having a means to attach to the wall or door or panel;

a hollow tubular cover connected to the backing member;

a tubular members configured to slide into the hollow tubular cover enabling an adjustable height dumbbell attachment;

a rack assembly configured for supporting dumbbell, the rack assembly having a connector member; and two body members for supporting a dumbbell, two body members attached to the connector member, the body members being spaced sufficiently far apart from each other to permit the insertion of a hand therebetween to allow for a person to manipulate the dumbbell.

2. The dumbbell attachment of claim 1, wherein the rack assembly for supporting dumbbell is a right hand rack assembly configured for supporting dumbbells for the right hand, such that:

the connector member coplanar to the tubular member, the connector member protruding left of the tubular member forming a right angle with the tubular member.

3. The dumbbell attachment of claim 2, wherein the connector member is configured to be an adjustable length leftwards.

4. The dumbbell attachment of claim 1, wherein the rack assembly for supporting dumbbell is a left hand rack assembly configured for supporting dumbbells for the left hand, such that:

a connector member coplanar to the tubular members, the connector member protruding right of the tubular members forming a right angle with the tubular members.

5. The dumbbell attachment of claim 4, wherein the connector member having an adjustable length rightwards.

6. The dumbbell attachment of claim 1, wherein each of the body members having distinct harvesting sickle shape as viewed from one side.

7. The dumbbell attachment of claim 6, wherein the handle of the harvesting sickle forming the distal end of the body member attached to the connector member.

8. The dumbbell attachment of claim 7, wherein the handle having an adjustable length.

9. The dumbbell attachment of claim 1 further comprises means for adjusting securely the hollow tubular cover at various heights of the vertical tubular member.

10. The dumbbell attachment of claim 1, wherein the hollow tubular cover and the connector member being coplanar, forming a two dimensional planes with the body member at a right angle with the connector member.

* * * * *